US007066812B2

(12) United States Patent
Fried et al.

(10) Patent No.: US 7,066,812 B2
(45) Date of Patent: Jun. 27, 2006

(54) METHODS AND APPARATUS FOR A PORTABLE GAMING MACHINE

(75) Inventors: Lee I. Fried, Calabasas, CA (US); Alex V. Freed, Belmont, CA (US)

(73) Assignee: LIF Capital LLC, San Leandro, CA (US)

( * ) Notice: Subject to any disclaimer, the term of this patent is extended or adjusted under 35 U.S.C. 154(b) by 8 days.

(21) Appl. No.: 10/391,934

(22) Filed: Mar. 19, 2003

(65) Prior Publication Data

US 2004/0204220 A1 Oct. 14, 2004

(51) Int. Cl.
*A63F 9/24* (2006.01)

(52) U.S. Cl. ..... 463/19; 273/269

(58) Field of Classification Search ..... 463/19; 273/269

See application file for complete search history.

(56) References Cited

U.S. PATENT DOCUMENTS 4,378,940 A 4/1983 Gluz et al.
4,455,025 A 6/1984 Itkis
4,624,462 A 11/1986 Itkis
RE32,480 E * 8/1987 Bolan ..... 463/19
4,768,151 A * 8/1988 Birenbaum et al. ..... 463/19
4,856,787 A 8/1989 Itkis
5,007,649 A 4/1991 Richardson
5,043,887 A 8/1991 Richardson
5,054,787 A 10/1991 Richardson
5,072,381 A * 12/1991 Richardson et al. ..... 463/19
5,482,289 A 1/1996 Weingardt
5,533,727 A * 7/1996 DeMar ..... 463/23
5,569,083 A 10/1996 Fioretti
5,687,971 A 11/1997 Khaladkar
5,951,396 A 9/1999 Tawil
5,967,895 A * 10/1999 Kellen ..... 463/19
6,306,038 B1 10/2001 Graves et al.
6,354,941 B1 * 3/2002 Miller et al. ..... 463/19
6,645,072 B1 * 11/2003 Kellen ..... 463/19
6,769,991 B1 * 8/2004 Fields ..... 463/43

* cited by examiner

*Primary Examiner*—Julie Brocketti
(74) *Attorney, Agent, or Firm*—Stattler, Johansen & Adeli LLP

(57) ABSTRACT

The invention is directed towards a method and apparatus for a portable gaming machine. The method activates several bingo games that are stored in the portable gaming machine. The activation makes the bingo games available to a bingo player for playing. The bingo player is presented with an option to switch from a first bingo game to a second bingo game while retaining numbers entered by the bingo player in the first bingo game. The method also records every keystroke entered by a bingo player for each game. These keystrokes can be displayed in an expeditious manner to a gaming official upon entering of a password.

17 Claims, 13 Drawing Sheets

Figure 2A
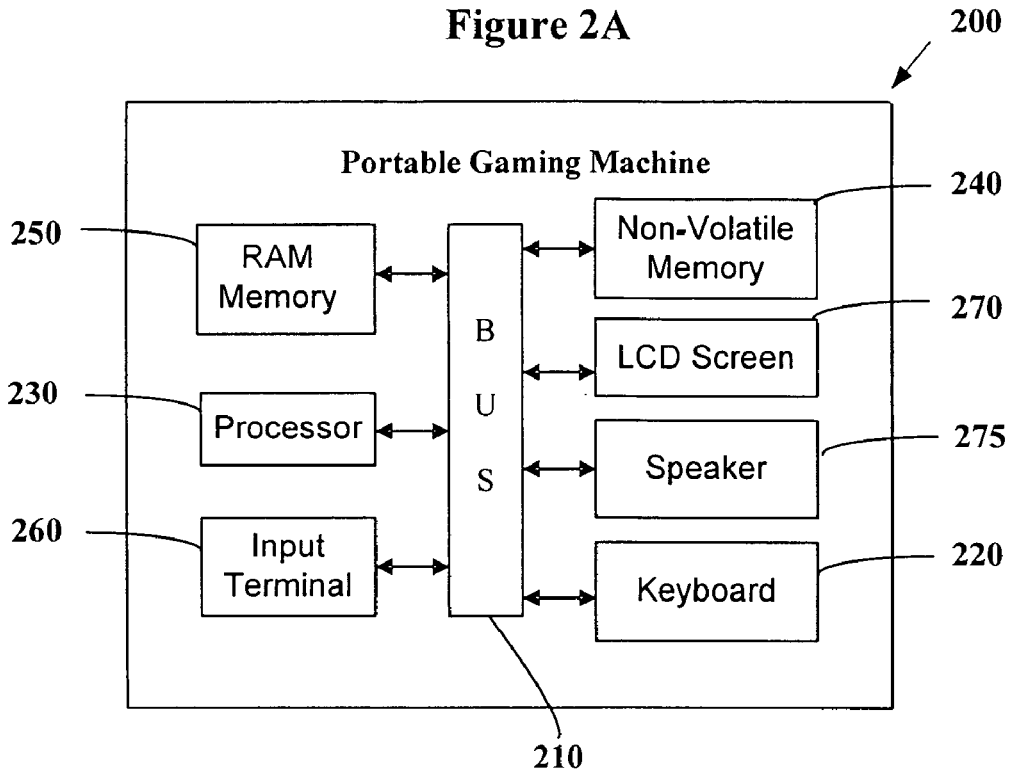
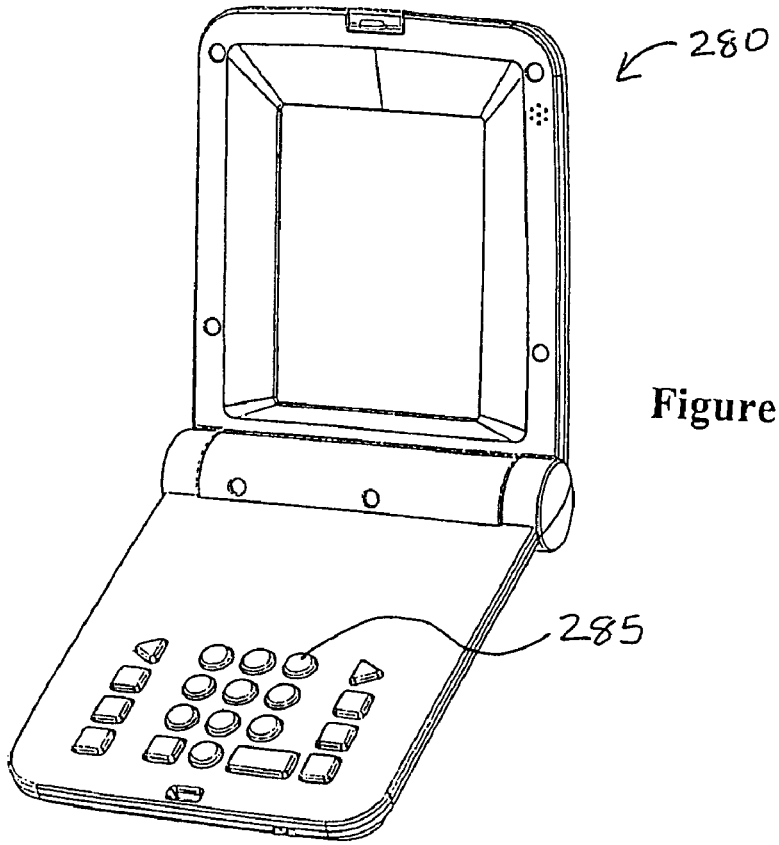
Figure 2B

Figure 4

400

GAMING INFORMATION DISPLAY

| Game | Cards | Pattern |
|---|---|---|
| 1 | 48 | Letter 'X' |
| 2 | 48 | Letter 'T' |
| 3 | 72 | Florida Single |
| 4 | 72 | Florida Double |
| 5 | 72 | Florida Single |
| 6 | 72 | Florida Double |
| 7 | 72 | Coverall (Blackout) |
| 8 | 72 | Florida Single |
| 9 | 72 | Florida Double |
| 10 | 72 | Coverall (Blackout) |
| 11 | 48 | Combination |
| | | Block Of MIME |
| | | Florida Double |
| | | Florida Single |

Figure 5

515 510 500

Game Number 4
FLORIDA Double

Numbers Called 62
Last Number 13

520

| B | I | N | G | O |
|---|---|---|---|---|
| 12 | 23 | 35 | 46 | 67 |
| 72 | 56 | 49 | 33 | 21 |
| 20 | 44 | Free | 27 | 11 |
| 17 | 2 | 4 | 48 | 31 |
| 1 | 20 | 29 | 33 | 9 |

| B | I | N | G | O |
|---|---|---|---|---|
| 1 | 12 | 72 | 18 | 41 |
| 12 | 0 | 52 | 33 | 36 |
| 20 | 44 | Free | 27 | 11 |
| 55 | 2 | 48 | 23 | 30 |
| 29 | 20 | 22 | 6 | 61 |

| B | I | N | G | O |
|---|---|---|---|---|
| 41 | 12 | 72 | 18 | 8 |
| 1 | 0 | 37 | 31 | 36 |
| 18 | 44 | Free | 23 | 11 |
| 9 | 2 | 3 | 48 | 30 |
| 29 | 41 | 22 | 6 | 66 |

| B | I | N | G | O |
|---|---|---|---|---|
| 12 | 60 | 72 | 3 | 8 |
| 1 | 0 | 37 | 31 | 72 |
| 56 | 33 | Free | 17 | 11 |
| 9 | 2 | 19 | 48 | 30 |
| 20 | 41 | 22 | 70 | 16 |

| B | I | N | G | O |
|---|---|---|---|---|
| 18 | 66 | 28 | 3 | 20 |
| 1 | 4 | 26 | 31 | 72 |
| 70 | 23 | Free | 11 | 44 |
| 9 | 73 | 19 | 12 | 33 |
| 14 | 41 | 32 | 55 | 28 |

| B | I | N | G | O |
|---|---|---|---|---|
| 23 | 60 | 14 | 3 | 51 |
| 1 | 4 | 37 | 31 | 72 |
| 63 | 33 | Free | 17 | 53 |
| 2 | 73 | 19 | 70 | 30 |
| 44 | 41 | 22 | 55 | 16 |

Figure 6A

600

610

Game Number 4

FLORIDA Double

Numbers Called 23

Last Number 18 1 60 5 14 29 44 11 39

| B | I | N | G | O |
|---|---|---|---|---|
| 12 | 23 | 35 | 46 | 67 |
| 70 | 56 | 49 | 33 | 21 |
| 30 | 44 | Free | 27 | 11 |
| 13 | 2 | 4 | 48 | 31 |
| 1 | 20 | 29 | 32 | 9 |

| B | I | N | G | O |
|---|---|---|---|---|
| 1 | 12 | 77 | 18 | 2 |
| 70 | 3 | 52 | 33 | 36 |
| 31 | 44 | Free | 27 | 11 |
| 55 | 2 | 48 | 23 | 30 |
| 29 | 20 | 22 | 6 | 61 |

| B | I | N | G | O |
|---|---|---|---|---|
| 5 | 12 | 70 | 18 | 8 |
| 1 | 4 | 37 | 31 | 36 |
| 18 | 44 | Free | 23 | 11 |
| 14 | 2 | 3 | 48 | 30 |
| 29 | 41 | 22 | 6 | 66 |

| B | I | N | G | O |
|---|---|---|---|---|
| 12 | 60 | 71 | 3 | 8 |
| 1 | 4 | 37 | 31 | 72 |
| 56 | 33 | Free | 17 | 11 |
| 14 | 2 | 19 | 48 | 30 |
| 13 | 41 | 22 | 70 | 16 |

615

| | B | I | N | G | O |
|---|---|---|---|---|---|
| N | 18 | 66 | 28 | 3 | 20 |
| E | 1 | 4 | 26 | 31 | 72 |
| E | 70 | 23 | Free | 11 | 44 |
| D | 14 | 73 | 19 | 60 | 33 |
| 70 | 5 | 41 | 32 | 55 | 28 |

| B | I | N | G | O |
|---|---|---|---|---|
| 54 | 60 | 14 | 3 | 51 |
| 1 | 4 | 37 | 31 | 72 |
| 63 | 33 | Free | 17 | 53 |
| 14 | 73 | 19 | 70 | 30 |
| 44 | 41 | 22 | 55 | 16 |

Press NEXT to verify

Figure 6B

Game 4
Florida Double

Winning 1 of 1

Serial number 115768 Level 1

| | | | | |
|---|---|---|---|---|
| 5 | 12 | 70 | 18 | 8 |
| 1 | 4 | 37 | 31 | 36 |
| 18 | 44 | Free | 23 | 11 |
| 14 | 2 | 3 | 48 | 30 |
| 29 | 41 | 22 | 6 | 66 |

BINGO

630

Sequence number 59
Card Library Turbo Bingo 1
Last Number Entered 23
12/10/2002 15:07
Numbers for Bingo: 18 1 5 14 29 44 11 23

Figure 7

GAMING INFORMATION DISPLAY

| Game | Cards | Pattern |
|---|---|---|
| 1 | 48 | Letter 'Y' |
| 2 | | |
| 3 | | |
| 4 | | |
| 5 | | |
| 6 | 72 | Florida Double |
| 7 | 72 | Coverall (Blackout) |
| 8 | 72 | Florida Single |
| 9 | 72 | Florida Double |
| 10 | 72 | Coverall (Blackout) |
| 11 | 48 | Combination |
| | | Block Of Mine |
| | | Florida Double |
| | | Florida Single |

Switch to another game?

(Enter- yes, Clear – no)

Figure 8

Use the entered number?

(Enter- yes, Clear – no)

Game Number 3
FLORIDA Single

Numbers Called
Last Number

| B | I | N | G | O |
|---|---|---|---|---|
| 12 | 23 | 35 | 46 | 67 |
| 72 | 56 | 13 | 33 | 21 |
| 37 | 44 | Free | 27 | 11 |
| 3 | 2 | 4 | 64 | 31 |
| 48 | 20 | 29 | 34 | 39 |

| B | I | N | G | O |
|---|---|---|---|---|
| 72 | 12 | 73 | 18 | 2 |
| 13 | 0 | 52 | 33 | 36 |
| 37 | 44 | Free | 27 | 11 |
| 55 | 64 | 48 | 23 | 30 |
| 29 | 20 | 22 | 6 | 61 |

| B | I | N | G | O |
|---|---|---|---|---|
| 72 | 60 | 39 | 3 | 51 |
| 53 | 4 | 37 | 31 | 72 |
| 63 | 33 | Free | 17 | 64 |
| 9 | 73 | 19 | 70 | 30 |
| 44 | 41 | 22 | 55 | 16 |

| B | I | N | G | O |
|---|---|---|---|---|
| 12 | 60 | 72 | 3 | 13 |
| 41 | 0 | 37 | 31 | 72 |
| 56 | 33 | Free | 17 | 11 |
| 9 | 2 | 19 | 48 | 30 |
| 88 | 64 | 22 | 39 | 16 |

Game Number 3
FLORIDA Single

Numbers Called
Last Number

| B | I | N | G | O |
|---|---|---|---|---|
| 12 | 23 | 35 | 46 | 67 |
| 72 | 56 | 13 | 33 | 21 |
| 37 | 44 | Free | 27 | 11 |
| 9 | 2 | 4 | 64 | 31 |
| 48 | 20 | 29 | 34 | 39 |

| B | I | N | G | O |
|---|---|---|---|---|
| 72 | 12 | 73 | 18 | 2 |
| 13 | 0 | 52 | 33 | 36 |
| 37 | 44 | Free | 27 | 11 |
| 55 | 64 | 48 | 23 | 30 |
| 29 | 20 | 22 | 6 | 61 |

| B | I | N | G | O |
|---|---|---|---|---|
| 72 | 60 | 39 | 3 | 51 |
| 53 | 4 | 37 | 31 | 72 |
| 63 | 33 | Free | 17 | 64 |
| 9 | 73 | 19 | 70 | 30 |
| 44 | 41 | 22 | 55 | 16 |

| B | I | N | G | O |
|---|---|---|---|---|
| 12 | 60 | 72 | 3 | 13 |
| 41 | 0 | 37 | 31 | 72 |
| 56 | 33 | Free | 17 | 11 |
| 9 | 2 | 19 | 48 | 30 |
| 88 | 64 | 22 | 39 | 16 |

14:51 10/29/2002

Serial Number: TB0018710b

Adjust

1. – contrast

2. – volume

3. – brightness

4. – click

5. – beep

6. – choose a dauber shape

METHODS AND APPARATUS FOR A PORTABLE GAMING MACHINE

FIELD OF INVENTION

The invention relates generally to electronic gaming systems. More specifically, the present invention relates to methods and apparatus for a portable gaming machine.

BACKGROUND OF THE INVENTION

Bingo games can be played using electronic gaming machines. These gaming machines are loaded and made ready for play by electronically transferring data representing a set of bingo games from a sales terminal to the electronic gaming machine. Once these machines are loaded, they allow bingo players to play several bingo games at one time. Each bingo game has a set of game cards that are electronically daubed when a player entered number matches a number on a bingo game card.

Bingo players often decide to switch between bingo games during play. If the player decides to switch to a new game, the player must re-enter all the numbers entered in the previous game for the numbers to be daubed onto the new game. Since the current bingo machines do not allow a mechanism for carrying numbers as the player switches games, re-entering numbers becomes very laborious and time consuming. This process is also inefficient as a player risks missing entering a number currently being called and thus risks not winning.

Bingo games are subject to state laws and regulations that are carried out by gaming commissions. One of the regulations requires a gaming official to be able to review all the keystrokes entered by a bingo player during play. A problem with the current gaming machines is that they do not provide an easy method of logging keystrokes or displaying the keystrokes to a gaming official in a quick and efficient manner.

Thus, there is a need for an electronic bingo machine that maneuvers between bingo games in an efficient manner, so to retain entered numbers from one bingo game for use in another bingo game, and that logs, transfers and displays every keystroke in a quick and efficient manner

SUMMARY OF THE INVENTION

The invention is directed towards a method and apparatus for a portable gaming machine. The method activates several bingo games that are stored in the portable gaming machine. The activation makes the bingo games available to a bingo player for playing. The bingo player is presented with an option to switch from a first bingo game to a second bingo game while retaining numbers entered by the bingo player in the first bingo game. The method also records every keystroke entered by a bingo player for each game. These keystrokes can be displayed in an expeditious manner to a gaming official upon entering of a password.

BRIEF DESCRIPTION OF THE DRAWINGS

The novel features of the invention are set forth in the appended claims. However, for purpose of explanation, several embodiments of the invention are set forth in the following figures.

FIG. 2A illustrates one embodiment of the portable gaming machine.

FIG. 2B illustrates a portable gaming machine for playing bingo like games according to one embodiment.

FIG. 4 illustrates a display that shows gaming information for games currently available for play according to one embodiment.

FIG. 5 illustrates a display that shows a bingo game with 6 game cards displayed on the display at a time according to one embodiment.

FIG. 6A illustrates a display that shows numbers daubed onto a bingo game having 6 game cards displayed on the display at a time according to one embodiment.

FIG. 6B illustrates a display that shows a wining game card and information associated with the winning game card according to one embodiment.

FIG. 7 illustrates a switch game window that allows the bingo player to switch from one bingo game to another bingo game according to one embodiment.

FIG. 8 illustrates a number option window that allows the bingo player to retain numbers from a previous bingo game and use them in a subsequent bingo game according to one embodiment.

DETAILED DESCRIPTION

The invention relates generally to electronic gaming systems. More specifically, the present invention is directed towards methods and apparatus for a portable gaming machine. The method activates several bingo games that are stored in the portable gaming machine. The activation makes the bingo games available to a bingo player for playing. The bingo player is presented with an option to switch from a first bingo game to a second bingo game while retaining numbers entered by the bingo player in the first bingo game. The method also records every keystroke entered by a bingo player for each game. These keystrokes can be displayed in an expeditious manner to a gaming official upon entering of a password.

Activating bingo games stored within the portable gaming machine requires a sales terminal to transfer a minimal amount of data to the portable gaming machine for making the portable gaming machine ready for play. This greatly eliminates long loading times and makes the portable gaming machine ready for play in an expeditious manner.

In addition, providing an option to switch from one bingo game to another while accurately retaining the numbers from a prior bingo game allows a bingo player to play numerous bingo games at one time. Since the announcer in a bingo session calls a number every fifteen seconds or less, the ability to transfer numbers accurately from one bingo game to another become crucial as it allows the bingo player to jump to the next bingo game without missing any called numbers. This greatly increases the probability of winning for the bingo player.

Furthermore, recording every keystroke and displaying the recorded keystrokes in an expeditious manner permits the gaming officials to quickly verify a win. Password entry also protects the logged keystrokes from being accessed by a bingo player and thus prevents any tampering.

The portable bingo machine also includes a selectable menu display that allows a bingo player to select a bingo game and have displayed all necessary information required for playing that game. The selectable menu display also allows a bingo player to view all the bingo games available for play and serves as a great tool for maneuvering between the numerous bingo games through easy selectable menus.

Figure 1:
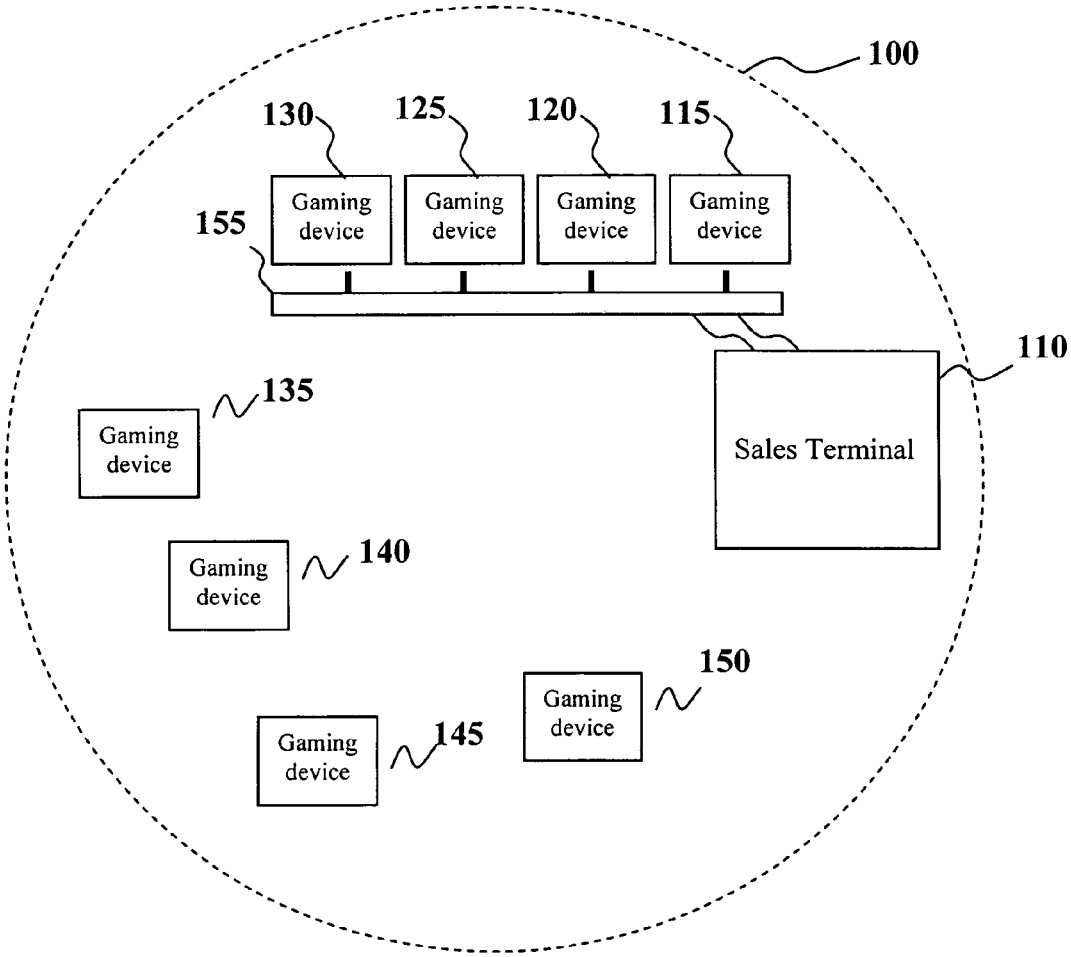
FIG. 1 illustrates an overview of the gaming environment in which the invention is practiced according to one embodiment.

FIG. 1 illustrates a gaming environment 100 in which the invention is practiced according to one embodiment. The gaming environment 100 includes a sales terminal 110 and several portable gaming machines 115, 120, 125, 130, 135, 140, 145, and 150. Each portable gaming machine 115, 120, 125, 130, 135, 140, 145, and 150 is a self contained portable computer unit in size and shape resembling a small laptop computer. The portable gaming machine 115, 120, 125, 130, 135, 140, 145, and 150 is battery powered and may be recharged by electrically coupling it to a recharging rack 155. The portable gaming machine 115, 120, 125, 130, 135, 140, 145, and 150 also includes a motherboard that may include a smart media memory device.

The sales terminal 110 activates the portable gaming machines 115, 120, 125, 130, 135, 140, 145, and 150 and makes them ready for playing bingo games. The activation process includes activating a selected number of games and game cards associated with each game that have been stored in the portable gaming machine 115, 120, 125, 130, 135, 140, 145, and 150. The selected number depends upon the transactions between the bingo player and the sales terminal operator. For example, a bingo player desiring to play 10 games of Florida Double Bingo would compensate the sales terminal operator for the 10 games. The sales terminal operator in return would activate 10 games of Florida double from the portable gaming machine's storage.

Activation may include electrically coupling the sales terminal 110 to the portable gaming machine 115, 120, 125, 130, 135, 140, 145, and 150 and transmitting an activation signal. The activation signal allows a set of serial numbers associated with the selected bingo games to be activated and make the bingo games available for playing. Data may be transferred via electrical cable, such as RS 232, via infrared (IrDA) or via removable media, such as a SmartCard. For example, in one instance, a cable wire having a connector coupled to the input terminal 260, which is coupled to the portable gaming machines 115, 120, 125, 130, 135, 140, 145, and 150, may also be coupled to an output terminal of the sales terminal 100 for providing the electrical connection for sending and receiving the activation signal.

The portable gaming machines 115, 120, 125, 130, 135, 140, 145, and 150 may be activated one by one by either coupling directly to the sales terminal 100 or by being electrically coupled to the sales terminal 110 through the rechargeable rack 155. In addition, several portable gaming machines 115, 120, 125, and 130 may also be activated at one time through an electrical coupling between the sales terminal 110, the rack 155, and the portable gaming machine 115, 120, 125, and 130.

FIG. 2A illustrates one embodiment of the portable gaming machine 280. The computer system 200 includes a Bus 210, user interface 220, a processor 230, a non-volatile memory 240, a random access memory (RAM) 250, input terminal 260, display 270 (e.g., LCD screen), speaker 275 and keyboard 220.

Bus 210 is a standard system bus for communicating information and signals. It allows communication between all devices 220, 230, 240, 250, 260, 270, and 275 of the portable gaming machine 280. For example, bus 210 communicatively couples the processor 230 with the display 270 for displaying bingo games and allowing a bingo player to play the displayed bingo games.

FIG. 2B illustrates one embodiment for the portable gaming device. The portable gaming device 280 includes a keyboard 285. The keyboard 285 allows a bingo player to enter commands. The commands range from pushing numbered buttons on the keyboard 285 for daubing them onto a bingo game, selecting a type of bingo game, maneuvering between several bingo games, selecting data for display, and adjusting display parameters. The bingo player may also use the keyboard 285 to highlight selectable areas on display 270 for entering a command. Alternatively, the bingo player may also use the display 270 as a touch screen for entering commands. Each command entered by the bingo player is recorded as will be discussed further in more detail.

The processor 230 receives these commands from the keyboard 220, and responds by performing the tasks required by the entered command. Specifically, when the bingo player makes a selection to play a particular type of bingo game, the processor 230 receives the command, and retrieves the selected game from the non-volatile memory 240. The software for the device further stores the retrieved games in RAM memory 250. The games and game cards associated with each game are then displayed on the display 270. Only the games and game cards that have been activated by the sales terminal 110 are retrieved by the processor 230 and provided for bingo player selection.

The non-volatile memory 240, permanent memory (i.e., retains information without power), also stores information pertaining to the bingo games. For example, non-volatile memory 240 stores a game library that is accessed by the processor 230 for providing bingo card faces and win patterns to a bingo player. The game library includes all types of bingo games and game cards that can be played in the gaming environment 100. However, as discussed previously, only games and game cards activated earlier by the sales terminal 110 are transferred to RAM 250 and accessible to the bingo player. The non-volatile memory 240 also stores software instructions for execution by the processor 230.

Operation of the portable gaming machine and various methods of playing bingo games using the portable gaming machine are implemented by executing code or machine readable instructions. The sets of instructions are executed by the processor 230 to provide gaming capability to a bingo player. The software also performs function of storing data, such as bingo player keystroke and commands, game descriptions, bingo session information, such as number of games played, winning combinations, user display settings, and bingo schedules. In the case of logging keystrokes, the processor 230 stores into RAM 250 every keystroke entered by the bingo player during a game session. Once the game is terminated, the logged entries for a game are transferred to the non-volatile memory 240 for permanent storage.

Figure 3:
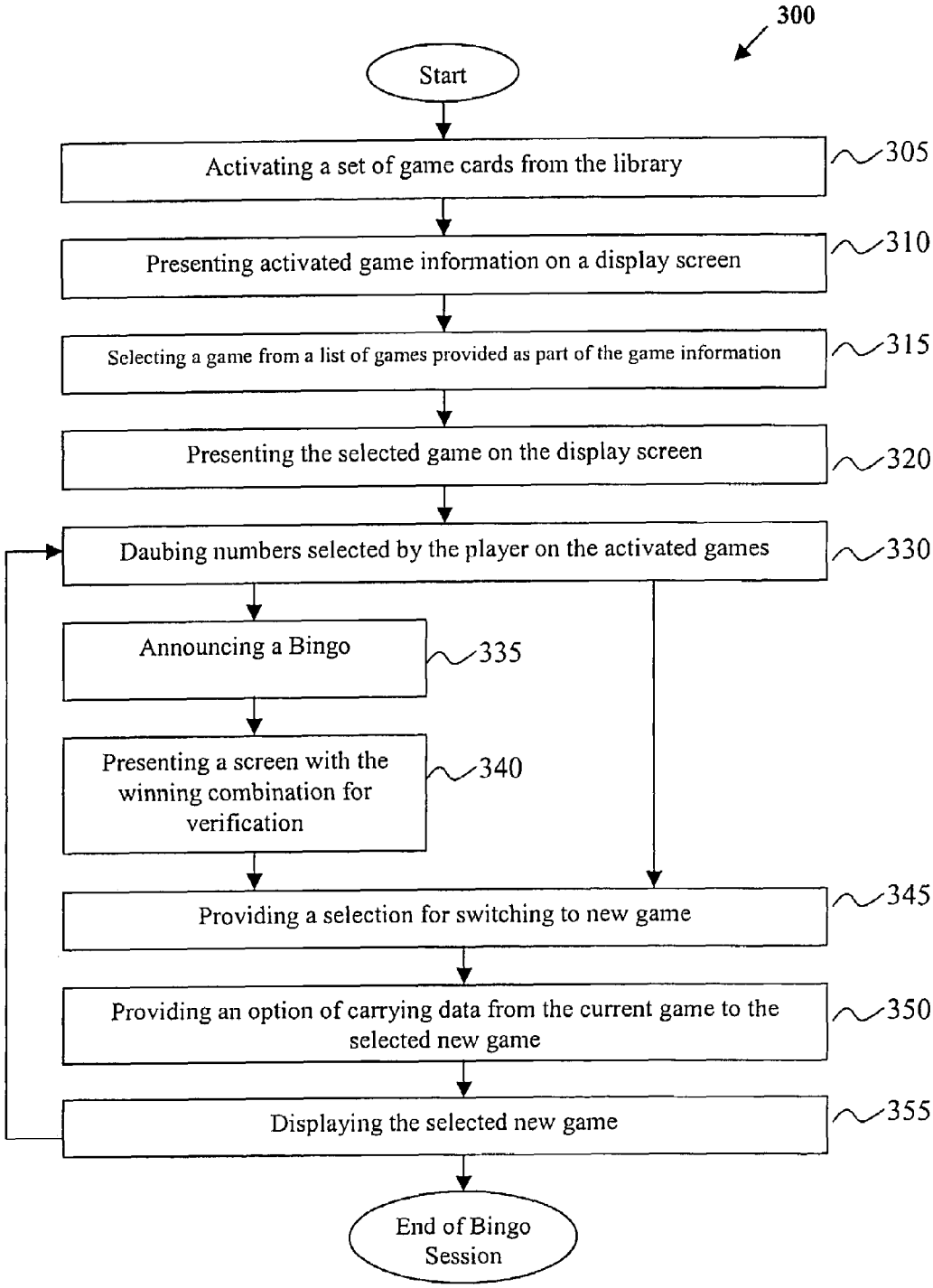
FIG. 3 illustrates a process for using the portable gaming machine for playing a series of bingo games according to one embodiment.

FIG. 3 illustrates a process 300 for using the portable gaming machine 280 for playing a series of bingo games according to one embodiment. The process 300 (at 305) directs initial programming of the portable gaming machine 280 by the sales terminal 110. The programming activates a predetermined number of games and game cards associated with each game. Activation includes moving the predetermined number of games and game cards from a game library stored in the portable gaming machine's non-volatile memory 240 to the portable gaming machine's RAM 250. As discussed previously, the predetermined number is based upon the sales transaction between the bingo player and the sales terminal. After the bingo player compensates a sales terminal operator to purchase a number of games that are part of the current bingo session, the sales terminal operator, using the sales terminal 110, activates the bingo games stored within the portable gaming machine 280. This activation makes the portable gaming machine 280 ready for use. The player may proceed to play bingo games during the bingo session.

Alternatively, once the activation is complete (at 310), a display screen appears as the bingo player powers on the portable gaming machine 280 (as shown in FIG. 4). The display screen 400 displays the gaming information necessary for playing the bingo games currently in session. The gaming information includes number of games, number of game cards for each game, and a description of the game. For example, display screen 400 shows 11 games, either 42 or 72 game cards for each game, and a description of each game. This also indicates the games and game cards purchased by the bingo player and activated by the sales terminal 110.

If the player does not just automatically begin to play the first game in the bingo session, the bingo player (at 315) makes a game selection from a list of games displayed as part of the gaming information. In making the selection, the bingo player uses the keyboard 220 (e.g., the keyboard 285 to maneuver and select the desired type of game). This can be done by highlighting and by selecting a particular game number from the list of games. For example, as shown in FIG. 4, a user selection is made for game 4 (Florida Double).

Once a game selection has been made, (at 320) the game cards associated with the game are displayed on the display. In this example, there are 72 game cards associated with the selected game (Game 4—Florida Double). This selection indicates that the player is now playing all 72 cards simultaneously.

The display may be configured to show a preset number of cards per screen. The preset number may be any number up to 6 cards. If no preset is configured, the display shows 6 game cards as a default. A bingo player may view the remaining of the 72 cards by pressing the "next" button on the keyboard 285. FIG. 5 shows one exemplary 6 game card display. The display 500 also includes a winning pattern box 510, game information 515, and called number display 520. The winning pattern box 510 displays a pattern required to win the bingo game. The game information 515 indicates the game number and type of game being played, such as Florida Double. The called number display 520 indicates numbers called, which is the number most recently entered by the bingo player, such as number 3 in display 500, and last number, which are the last 10 numbers entered by the bingo player.

Once the game cards are displayed on the display screen 500, (at 330) the bingo player may start entering keystrokes on the keyboard 285. Keystrokes correspond to numbers and function keys on the keyboard 285. When the bingo player enters numbers on the keyboard 285 as they are called by the announcer in the bingo session, the numbers are electronically daubed if they matches a number on any of the 72 game cards. Electronic daubing consists of smearing or shading the entered number if the entered number matches a number on the game card. FIG. 6A shows one example of entered numbers daubed on any game cards where a number match occurs. For example entered numbers 18, 1, 60, 5, 14, 29, 44, 11, 39, and 23 are daubed as they match numbers on game cards and entered number 39 is not daubed as it does not match any number on the game cards.

Every keystroke, whether it corresponds to a number or function key on the keyboard, is logged in RAM and subsequently transferred to the non-volatile memory 240. For example, if a player enters number "8" using the keyboard 285, the entry is logged in RAM even if the number does not match any of the numbers on any game cards. This process is further explained in FIG. 13 in more detail.

If a bingo card is only one number away from the winning pattern, as indicated in the winning pattern box 610, the missing number 615 is indicated next to the game card. This alerts the bingo player that it's the last number needed to win (as shown in FIG. 6A).

Numbers are announced by the announcer and entered by the bingo players one number at a time. The entered numbers are daubed, as appropriate, until the winning pattern is reached. The winning pattern stored in the non-volatile memory is accessed by RAM to determine if the winning pattern is reached. Once a winning pattern is reached, (at 335) the device indicates the win, and informs the bingo player to press next for verification. The win may be indicated in several ways including flashing the words "BINGO" across the winning screen or generating a sound by the portable gaming machine 280 to indicate the win. The winning game card is then displayed (at 340) for verification (as shown in FIG. 6B). The winning card also includes the serial number of the winning card, such as serial number 115768, and winning information 630, such as winning sequence number, winning numbers, and date and time last number was entered for the win. Alternatively, a bingo player may not reach a winning pattern in a particular bingo session. This would occur if the numbers entered by the bingo player do not match numbers in the winning pattern on the game cards being played.

Verification may be a manual verification by a gaming official authorized to perform the verification. Alternatively, other methods of verification, such as electronic verification, are also contemplated. If verification proves that the daubed numbers do not match a winning combination, then a win is not entered for the bingo player. In such case, the bingo player may continue to play until the winning combination is reached and verified.

There may be several reasons why the daubed numbers do not match the winning combination. For example, if a bingo player is playing a game different from the game currently in session, then his win may not be verifiable. In addition, if the bingo player erred and entered numbers that were not called by the announcer, then his win is not verified. However, if the player is playing the game, which is currently in session and properly entered the numbers, then his win shall be verified.

If a bingo player is playing a game not currently in session, or simply wishes to play another game that is in session, then (at 345) the bingo player can enter a switch game command by selecting a key on the keyboard 285. Once the switch command is entered, processor 230 receives the commands and allows display 400 to reappear on the display. The bingo player may then use the keyboard 285 to maneuver and select a game from the list of available games in display 400. The selection is made by highlighting and by selecting a particular game number from the displayed list of games.

Once a selection is made to switch to a new game, the game selection is received by the processor 230 and, in response, a switch game window 710 is displayed as shown in FIG. 7. The switch game window 710 includes a Yes/No option. Selecting the "Yes" option indicates the desire of the bingo player to switch to a new game. Once the bingo player selects the "Yes" option, the selected information is again received by the processor 230, and the processor 230 displays a number(s) option window 810 as shown in FIG. 8.

Figure 9:
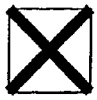
FIG. 9 illustrates display that shows numbers carried over from a previous bingo game and daubed onto the current bingo game having 4 game cards displayed on the display at a time according to one embodiment.

The number(s) option window 810 also includes a Yes/No option. The "Yes" option transfers the number(s), entered for the current game, to the new game. Alternatively, the portable gaming machine 280 may also be programmed to transfer only number(s) that are daubed in the previous game to the new game. If the bingo player accepts the "Yes" option, then a new game is displayed (at 355) and all the numbers entered or daubed in the previous game, depending on the programmed choice, are moved and daubed in the new game as shown in FIG. 9.

The process for moving entered or daubed numbers from the current game to the new game is performed in a quick and efficient manner. Since every entered number is stored in RAM 250, the processor retrieves the numbers entered or daubed from the RAM 250 and transfers them to the new game. This feature allows great maneuverability between games. It is also advantageous as the switch requires easy steps of highlighting and selecting a new game, thereby making it efficient for the bingo player to continue play in the next game session without missing any numbers announced in the new game session.

Figure 10:
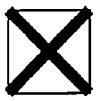
FIG. 10 illustrates display that a bingo game having 4 game cards displayed on the display at a time according to one embodiment.

Alternatively, a "No" option may also be selected. The processor 230 receives the information that a "No" option was selected, and in response to the selection, displays the new game (at 355) on the display. The new game is then displayed without carrying over any numbers from the previous game as shown in FIG. 10. A single bingo game may have several part games where each part can be played at a separate time. This option is available not only for switching from one bingo game to another bingo game but also for switching from parts within a bingo game.

The process is repeated again from 330 as the bingo player continues to daub numbers for winning in the new game. Once all the game types and games purchased have been played, the bingo session is terminated. As discussed previously, all the keystrokes from start of a game session to termination of the game session are logged in the RAM 250. Once the game session is terminated these logged entries are transferred to the non-volatile memory and stored permanently. If a gaming official wants to display these logged entries, the gaming official enters a special code, such as a password, using the keyboard 285. The processor verifies the password and retrieves the logged entries. After retrieval, the processor displays a screen having several lines where each line corresponds to numbers entered in a particular game. Once a line is selected from the list of lines, the logged entries for the selected game are displayed in a quick manner. In addition to keystrokes entered while playing a bingo game, any keystroke entered using the keyboard 285 for any purpose is also logged. Since reviewing all entered commands may be regulatory in some jurisdictions, the software code does not allow any tampering with the logged numbers.

Figure 11:
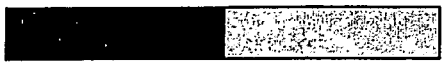
FIG. 11 illustrates a display adjustment screen 1100 according to one embodiment.

FIG. 11 illustrates a display adjustment screen 1100 according to one embodiment. The display adjustment screen 1100 includes parameters for controlling the display 270. These parameters include contrast, volume, brightness, click, and beep. It also includes a parameter for choosing the dauber shape. For example in FIGS. 6A, 6B and 9, a circle with smearing inside the circle is shown to indicate a daubed number. A bingo player may choose a different dauber shape, such as a box, with a different smearing pattern using the dauber shape parameter from the display adjustment screen 1100.

Figure 12:
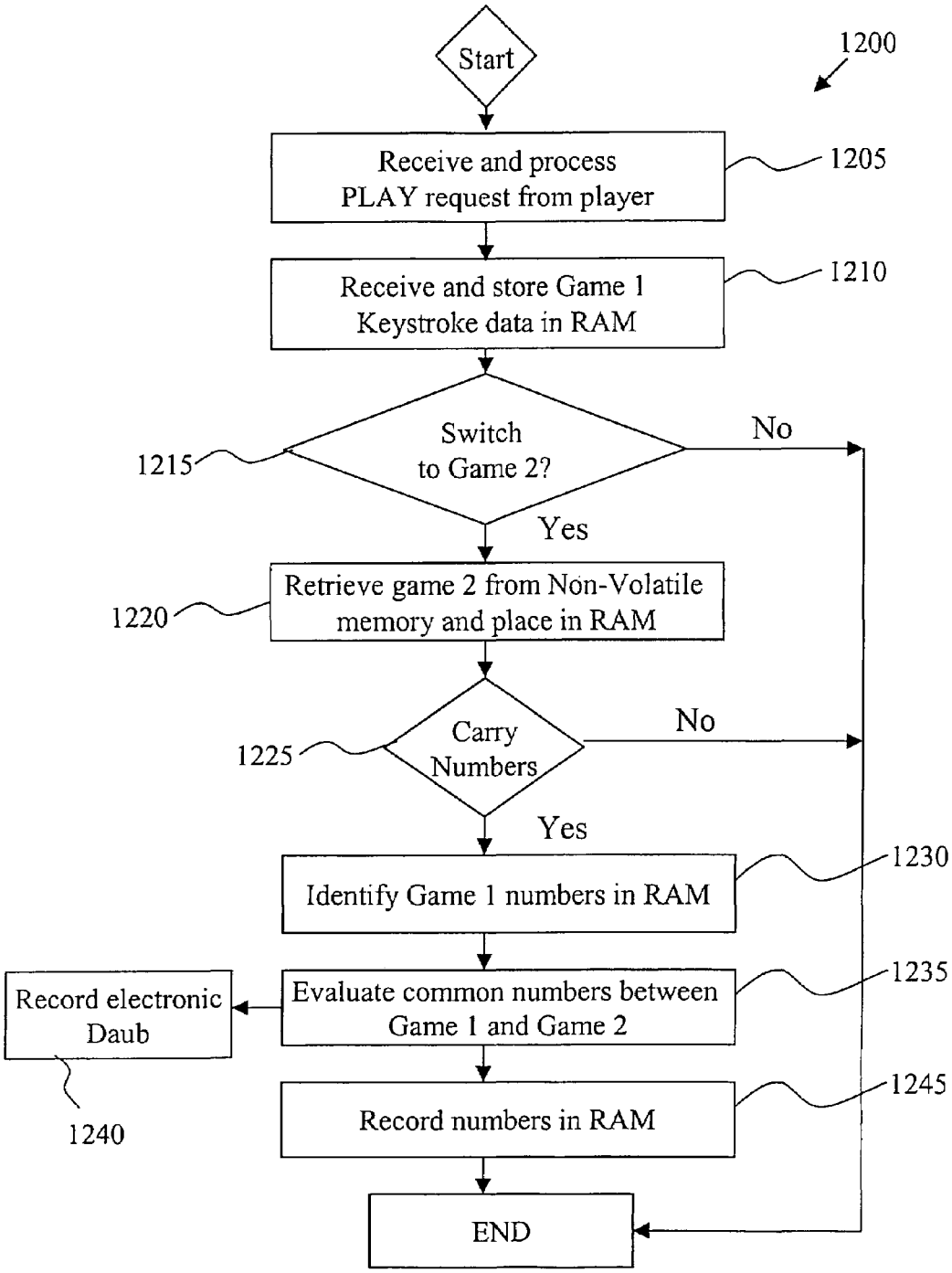
FIG. 12 illustrates a flow diagram that describes how the portable gaming machine retrieves a bingo game from the game library and transfers daubed numbers and keystrokes from one game to another.

FIG. 12 is a flow diagram of a process for the portable gaming machine 200 to retrieve a bingo game and its associated game cards from the game library and to transfer daubed numbers and keystrokes from one game to another. Initially, at step 1205, a request for play from a bingo player is received. This request is initiated when the bingo player selects a game, Game 1, from the game selection menu as displayed in FIG. 4. The request is processed to retrieve Game 1 from the game library and to place Game 1 in RAM to make it available for play by the bingo player.

Next, at step 1210, keystrokes entered by the bingo player while playing Game 1 are stored in a buffer located in RAM. Once Game 1 is finished, these keystrokes are transferred from RAM to non-volatile memory. This process is further explained in FIG. 13. In addition, an entered keystroke number is electronically daubed on a game card of Game 1 if the keystroke number matches any of the numbers on the game card grid.

Next, the bingo player may choose to switch to Game 2 while playing Game 1. If the bingo player so chooses, at step 1215 the player choice to switch is evaluated. Once a determination is made that the player chooses to switch to Game 2, then at step 1220 Game 2 is retrieved from the game library stored in the non-volatile memory and is placed in RAM to allow play. However, if the bingo player finishes Game 1 and does not request a switch, then the process is ended and the keystrokes entered are transferred from buffer in RAM to non-volatile memory.

At step 1225, an option is presented to the bingo player whether to transfer numbers entered in Game 1 to Game 2. At 1225, player selection of this option is evaluated and processed. If the bingo player does not wish to transfer the numbers, then the bingo player selects the "No" option and the process ends. However, if the bingo player selects the "Yes" option, then at step 1230 each keystroke stored for Game 1 in RAM is identified.

At step 1235, each identified keystroke number is evaluated for its match in Game 2. If a keystroke number entered in Game 1 matches any number on the game card face of Game 2, then, at step 1240, the matched numbers are electronically daubed on the matched bingo cards of Game 2 and recorded in RAM as a keystroke for Game 2. If the keystroke number does not match any number on the game cards for Game 2, then the keystroke is recorded in RAM (at step 1245) as a keystroke for the Game 2. However, no daubing occurs. The process continues until each keystroke entered in Game 1 is evaluated for its match in Game 2. Once all the keystrokes have been evaluated, the process ends at 1245.

Figure 13:
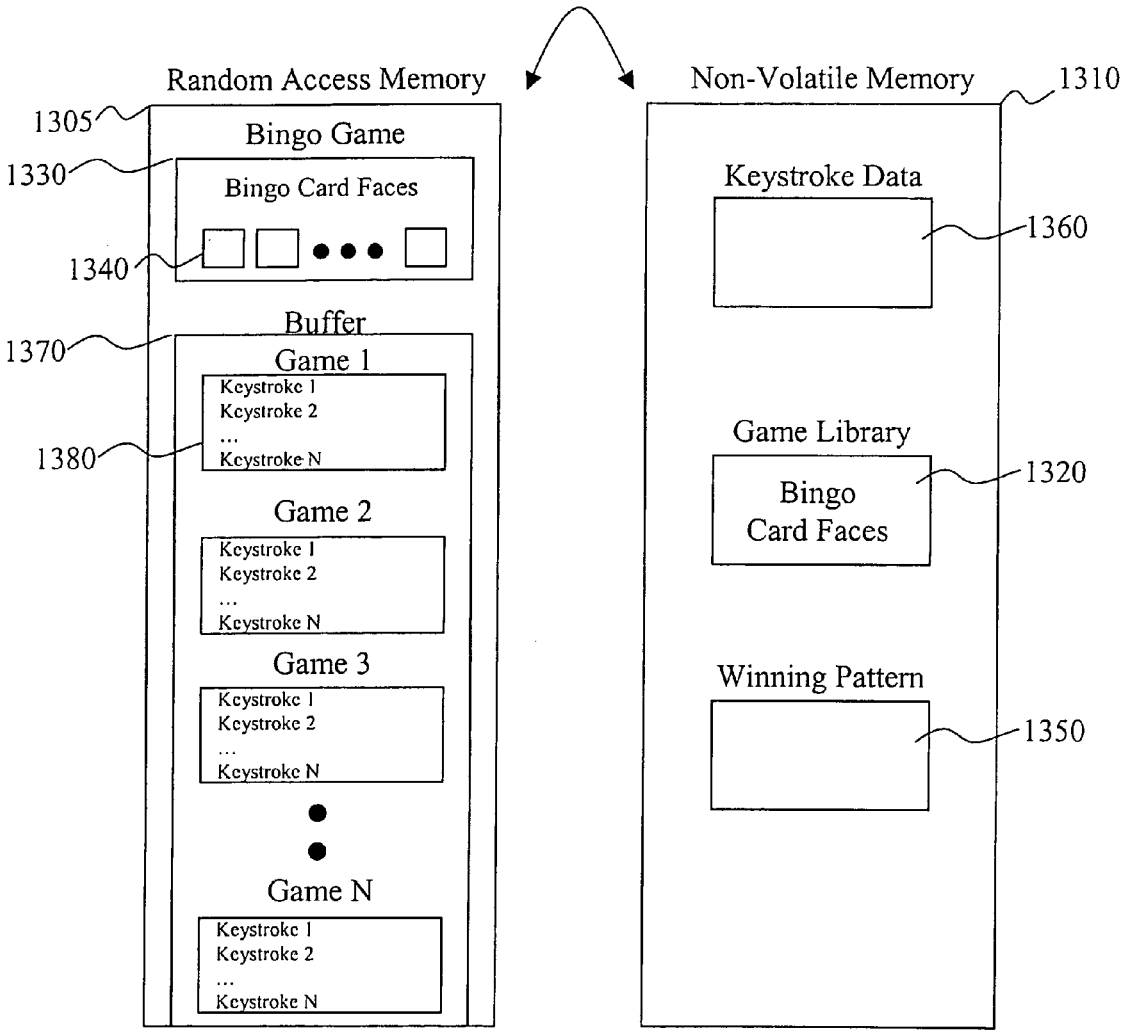
FIG. 13 illustrates an architectural block diagram of the random access memory and non-volatile memory of the portable gaming machine.

FIG. 13 illustrates a block diagram of the RAM and non-volatile memory of the portable gaming machine. The RAM 1305 communicates with the non-volatile memory 1310 through bus 210 for retrieving and storing data into the non-volatile memory 1310. As mentioned earlier, the non-volatile memory 1310 is a permanent storage for the game library 1320. When a player selects the type of bingo game to be played, as shown in FIGS. 4 and 7, the RAM 1305 retrieves the selected bingo game 1330 from the game library 1320 and places the bingo card faces 1340 in RAM 1305.

In addition to storing the game library 1320, the non-volatile 1310 memory also permanently stores bingo game winning patterns 1350 and keystroke data 1360. Both winning patterns 1350 and keystroke data 1360 are accessed and retrieved from RAM 1305. Winning patterns are retrieved to verify a win. The keystroke data is retrieved from non-volatile memory 1310 and is placed in RAM 1305 for display to a gaming official upon entering of a password.

Initially, keystroke data is stored in a buffer 1370 of the RAM. When a user is playing a bingo game, each keystroke entered is logged into this buffer 1370 under the type of game being played. For example, all the keystrokes entered while playing Game 1 will be entered under Game 1 (block 1380 in the buffer 1370). The buffer 1370 can store several Games, 1 to N, up to its storage capacity. When the buffer is full, the keystrokes from the oldest game are over written with the keystrokes of the game currently being played. However, the buffer 1370 includes enough capacity to store multiple games.

Once each game is finished, the block of keystroke data, corresponding to the finished game, is written to non-volatile memory 1310 and is stored permanently. Also, in addition to keystroke data, information such as date, time, game number, win, and failure information pertaining to the game is also transferred from RAM to non-volatile memory for storage. Once a gaming official enters a password using the keyboard 185, all of the stored keystrokes entered by the bingo player during the gaming session are accessed and presented on display 270.

What is claimed is:

1. A method for playing a bingo game on an electronic device, the method comprising:

storing a plurality of bingo games in a portable gaming machine for subsequent play by a user;

activating, on said portable gaming machine, a first bingo game for play by a user in a bingo hall environment;

receiving on said portable gaming machine at least one number for play of a second bingo game stored as one of said bingo games, said at least one number being called by an announcer in said bingo hall environment for said second bingo game, and entering said at least one number on said first bingo game;

displaying, on said portable gaming machine, an option to switch from said first bingo game to said second bingo game;

displaying, on said portable gaming machine, an option to advance said at least one number entered for said first bingo game for play on said second bingo game; and activating said second game and applying said at least one number to said second game if said user selects to switch to said second game and to advance said at least one number, respectively if said user was playing said first bingo game on said portable gaming machine while said announcer was calling said number for said second game.

2. The method of claim 1, wherein displaying an option for switching further comprises:

displaying a request to switch from the first bingo game to the second bingo game;

displaying an option menu based on the request, said option menu including a yes/no option for transferring numbers entered in the first bingo game to the second bingo game; and receiving a selection from one of the options from the displayed options menu for switching to the second bingo game.

3. The method of claim 2, wherein selecting one of the options from the options menu further comprising selecting a yes option for switching from the first bingo game to the second bingo game while retaining all the numbers entered in the first bingo game and daubing them in the second game if the entered numbers from the first bingo game match numbers on game cards associated with the second bingo game.

4. The method of claim 2, wherein receiving a selection of the options from the options menu further comprises selecting a 'no' option, said selection of said 'no' option resulting in displaying the second game on a display without transferring any numbers entered in the first bingo game.

5. The method of claim 1, further comprising:

receiving input for said first or second bingo game, and recording said input entered.

6. The method of claim 5, wherein recording said input further comprises writing said input into RAM.

7. The method of claim 6, further comprising transferring said input for a first or second bingo game from said RAM to non-volatile memory for permanent storage.

8. The method of claim 5, further comprising retrieving the input from the storage area and displaying the input on a display of said portable gaming machine.

9. The method of claim 8, wherein retrieving the input further comprises receiving a password subsequent to retrieving the recorded input.

10. The method of claim 1, wherein activating a plurality of games further comprises:

electrically coupling the portable gaming machine to a sales terminal;

transmitting a signal from the sales terminal to the portable gaming machine; and activating the plurality of games stored in the portable gaming machine based on said signal.

11. A portable gaming machine comprising:

non-volatile memory for storing a game library that includes a plurality of bingo games and gaming information associated with each bingo game; and a processor electrically coupled to the non-volatile memory for activating the bingo games stored in the game library, said processor for activating, on said portable gaming machine, a first bingo game for play by said user in said portable gaming machine in a bingo hall environment, for receiving on said portable gaming machine at least one number for play of a second bingo game stored as one of said bingo games, said at least one number being called by an announcer in said bingo hall environment for said second bingo game, for entering said at least one number on said first bingo game, for displaying, on said portable gaming machine, an option to switch from said first bingo game to said second bingo game, for displaying, on said portable gaming machine, an option to advance said at least one number entered for said first bingo game for play of said second bingo game, and for activating said second game and applying said at least one number to said second game if said user selects to switch to said second game and advance said at least one number, respectively, if said user was playing said first bingo game on said portable gaming machine while said announcer was calling said number for said second game.

12. The portable gaming machine of claim 11, wherein the processor further receives a request for switching from the first bingo game to the second bingo game, displays an option menu based on the request, said option menu including a yes/no option for transferring numbers entered in the first bingo game to the second bingo game, and allows selection of one of the options from the displayed options menu for switching to the second bingo game.

13. The portable gaming machine of claim 12, wherein the processor further receives one of the options from the options menu as a yes option, the switching from the first bingo game to the second bingo game while retaining all the numbers entered in the first bingo game, and for daubs the numbers entered in the second game if the entered numbers from the first bingo game match numbers on game cards associated with the second bingo game.

14. The portable gaming machine of claim 12, wherein the processor further receives one of the options from the options menu as a no option, and for displaying the second game on a display without transferring any numbers entered in the first bingo game.

15. The portable gaming machine of claim 11, wherein the processor records input entered by a bingo player in a storage area.

16. The portable gaming machine of claim 15, wherein the processor further writes input entered for a plurality of games into a random access memory.

17. The portable gaming machine of claim 15, wherein the processor further transfers input for each of the plurality of games from RAM to non-volatile memory for permanent storage.

* * * * *